United States Patent [19]

Hubbard et al.

[11] 4,240,665

[45] Dec. 23, 1980

[54] CONVEYOR MOUNTED VEHICLE

[75] Inventors: Terence Hubbard, Little Eaton; Eric A. Jackson, Swanwick, both of England

[73] Assignee: Perard Engineering Limited, Ripley, England

[21] Appl. No.: 969,707

[22] Filed: Dec. 15, 1978

[30] Foreign Application Priority Data

Dec. 20, 1977 [GB] United Kingdom ..... 53099/77
May 31, 1978 [GB] United Kingdom ..... 25975/78

[51] Int. Cl.[2] ..... E21C 35/20; E21C 35/06

[52] U.S. Cl. ..... 299/31; 105/161; 299/43; 299/64

[58] Field of Search ..... 299/31, 32; 180/8 C; 198/309, 315, 316, 862; 105/31, 32, 161; 104/4; 61/299–301; 173/23

[56] References Cited

U.S. PATENT DOCUMENTS

| | | | |
|---|---|---|---|
| 1,364,903 | 1/1921 | Thomas | 180/8 C |
| 1,879,446 | 9/1932 | Page | 180/8 C |
| 2,239,578 | 4/1941 | Sloane | 198/862 X |
| 2,800,970 | 7/1957 | Barrett | 180/8 C |
| 2,935,309 | 5/1960 | McCarthy | 299/31 |
| 3,576,225 | 4/1971 | Chambers | 180/8 C |
| 3,866,425 | 2/1975 | Morrice | 180/8 C |

*Primary Examiner*—Ernest R. Purser
*Attorney, Agent, or Firm*—Jones, Thomas & Askew

[57] ABSTRACT

A track-mounted vehicle having legs which can be retracted or extended, so that the vehicle can be raised to permit advancement of the track and then lowered, the vehicle either being raisable off the track to permit advancement, or having captivating means by which the track is raised, together with the vehicle, the track and the vehicle having rack-and-pinion or rack-and-chain drive means so that, in the raised position, the track can be advanced by said drive means and, in the lowered position, the vehicle is movable along the track by said drive means.

8 Claims, 8 Drawing Figures

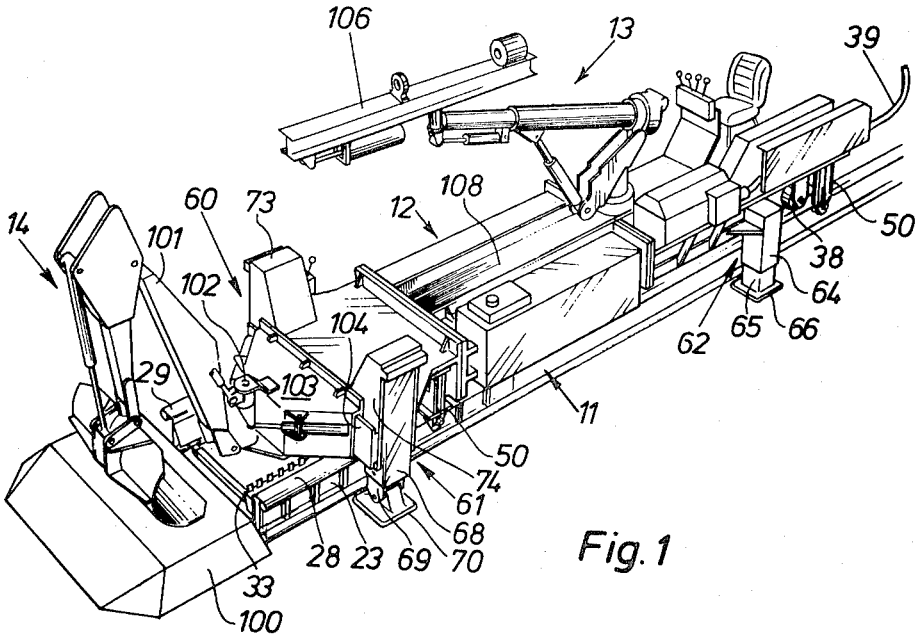
Fig. 1
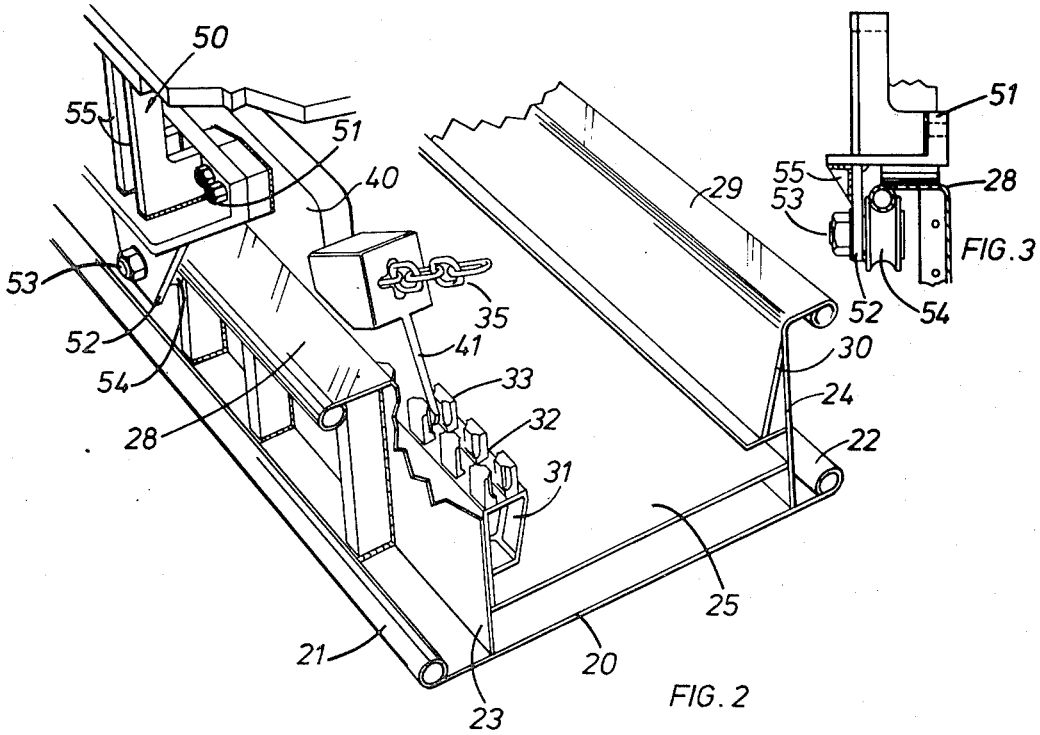
FIG. 3
FIG. 2

CONVEYOR MOUNTED VEHICLE

This invention relates to a track-mounted vehicle which can be, for example, adapted for excavation for use in mines for extending gates and for removing obstructive material in a gate, or for carrying power and switchgear equipment forward as advancement takes place.

According to the present invention, there is provided a track-mounted vehicle having drive means co-operable with means on the track for driving the vehicle along the track, characterised by extensible and retractable legs on the vehicle, and operating means for extending and retracting the legs, so as to raise the vehicle to facilitate movement of the track relative to the vehicle.

The invention is particularly useful for longwall mining. The vehicle may be provided with control gear or with excavating equipment and the track may be formed on a conveyor and laid in a gate (on roadway) adjacent an end of the mine face. As mineral is cut from face, it is necessary to extend the gate and for the conveyor to be advanced. Raising of the vehicle facilitates such advancement.

In a simple arrangement, the vehicle is raised above the track and hydraulic means may be used to advance the track.

It is preferred, however, that captivating means is provided for captivating the vehicle on the track, so that raising of the vehicle on the legs also raises the track clear of the ground, whereby operation of the drive means moves the track relative to the vehicle.

It is also preferred that at least two of the legs at opposite sides of the vehicle are mounted for lateral outward movement. In one embodiment, the legs are pivotally movable from an upright position, but the legs can be fixed to lateral slides. Power means are provided to effect such lateral movement of the legs individually and, by this means, the vehicle can be moveable sideways with accompanying sideways adjustment of the track. This permits accurate positioning of the track.

Reference is now made to the accompanying drawings, wherein;

FIG. 1 is a perspective view of a track-mounted vehicle according to the invention.

FIG. 2 is an enlarged perspective view of a part of the apparatus of FIG. 1.

FIG. 3 is a sectional view of a part of a captivating device, shown in FIG. 2;

Figure 4:
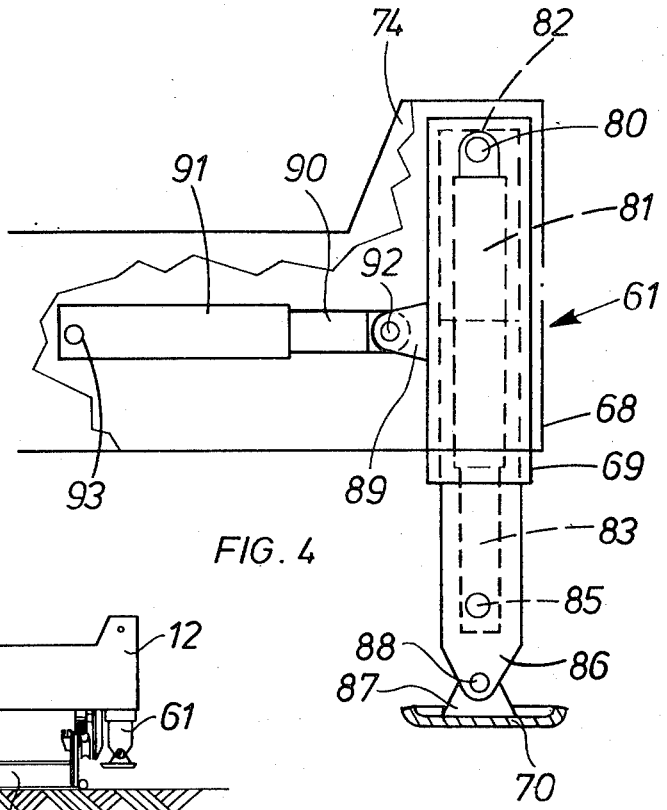
FIG. 4 is a diagrammatic view of a part of the apparatus showing operating piston-cylinder units.

Referring to FIG. 1, the apparatus shown comprises a stage-loader conveyor 11, mounting a vehicle 12 which carries a drilling device 13 and a loading device 14.

The conveyor 11 (see also FIG. 2) comprises a series of pans or sections joined together, each section comprising a bottom plate 20 having rolled ends 21, 22 providing reinforcement, and spaced upright plates 23, 24 defining sides of the conveyor pan. A partition plate 25 extends between the upright plates and in use a continuous conveying device, such as a conveying chain (not shown) is mounted with its upper run on top of the partition plate 25 and its lower run below the plate 25. The upper ends of the upright plates are rolled and define rails 28, 29 to form a track for the vehicle.

Reinforcement plates define box-section arrangements 30, 31 secured at both opposite sides of each conveyor pan to the upright plates and between the latter. One box-section arrangement 31 has a flat horizontal upper surface 32 mounting a rack of teeth 33. The teeth of the rack are shaped so as to receive links of a round-link chain.

The vehicle 12 has wheels 38, which support the machine on the rails 28, 29. The vehicle includes an electric motor and hydraulic motors (not shown) and the machine is fed by an external electric cable 39. Such an arrangement is conventional, for example, for driving a winning machine along a mineral face. The vehicle drive means effects rotary drive of a continuous round-link chain 35 (FIG. 2). A portion of the chain is urged into engagement with the rack of teeth 33 by a deflection device 40. The teeth are shaped so as to grip the peripheries of alternate links held in contact with the rack. Rotation of the chain, therefore, produces movement of the vehicle along the rails 28, 29. The rack and chain device is well known in association with winning machines from United Kingdom Patent Specifications Nos. 1500904 and 1500905.

The deflection device 40 also mounts plough members 41 (only one shown) at opposite ends for cleaning the rack as the vehicle moves along the rails. The plough member is also known.

Other drive means may be used, such as sprockets engageable with a rack or more conventional forms of rack and chain drive.

The vehicle is held captive on the conveyor by means of captivating devices 50 at both opposite sides of the vehicle. Each captivating device comprises a support plate 51 bolted to the machine and having dependent portion 52, which extends downwardly to a position below and to the outside of a corresponding rail 28, 29. This plate mounts a threaded shaft 53 on which is rotatably mounted a flanged roller 54 (FIGS. 2 and 3) which engages with the underside of the cylindrical rolled portion 28*a* of the rail 28 (or 29). The plate is reinforced by gussets 55.

The vehicle is provided, in this example, with two forward and two rearward support legs 60, 61 and 62 respectively. Only one of the rearward support legs 62 is shown, in FIG. 1, the other leg being laterally opposite to that illustrated. Each rearward leg 62 comprises a rectangular-section tubular member 64 fixed to the vehicle to extend vertically and a retractable member 65 telescopically engaged in the tubular member. The retractable member mounts a foot 66 through a pivotal joint (not shown). Each leg houses a piston-cylinder unit (not shown) which is hydraulically operable to extend and retract the leg 62 by action between the vehicle body and the retractable member 65. The foot 66 is freely pivotally movable according to the contours of the support surface. Extension of the legs 62 causes raising of the vehicle on the legs and the legs can be retracted sufficiently to be out of contact with the support surface for free running of the vehicle along the conveyor.

The forward legs 60, 61 are similar to the rear legs 62 and can similarly be extended and retracted. Each forward leg comprises a tubular member 68 a retractable member 69 and a universally pivoted foot 70.

With all four legs extended, the conveyor is raised off the ground, being supported by the captivating devices 50. Depending on the length of the conveyor, a rearward portion of the conveyor, at a distance from the vehicle may lie on the ground, articulation between sections of the conveyor permitting the conveyor to snake vertically. In this raised position, operation of the chain drive 35 causes the conveyor to be moved relative to the vehicle, so that the conveyor can be advanced relative to the vehicle. On retraction of the legs, the vehicle is again supported on the conveyor and the chain drive can be operated to advance the vehicle along the conveyor, so that the whole conveyor and vehicle have been advanced.

Unlike the rear legs 62, the forward legs 60, 61 are not fixed to the vehicle body, but are pivotally mounted in housings 73, 74 about axes parallel to the length of the conveyor. The housings serve as stops locating the forward legs in vertical orientations, but piston-cylinder units are provided to effect pivotal movement of the legs out of the housings, outwardly of the conveyor, FIG. 4 diagrammatically shows one of the forward legs 61. The tubular member 68 is shown pivoted in the housing 74 by a shaft 80. A vertical piston-cylinder unit 81 has its cylinder pivotally mounted on the shaft 80 by a lug 82. The piston rod 83 of the unit extends into the retractable member 69, which is hollow, and is mounted on a cross-piece 85 fixed transversely across the retractable member. The retractable member terminates in lugs 86 (only one shown) between which a boss 87 of the foot 70 extends. A spindle 88 pivots the foot to the retractable member, extending through the lugs 86 and the boss 87.

The tubular member carries a boss 89 to which is pivoted the piston rod 90 of a horizontal piston-cylinder unit 91 by a spindle 92. The cylinder is pivotally mounted by a spindle 93 on the body of the vehicle.

It will be seen that extension of the vehicle piston-cylinder unit 81 raises the vehicle on the leg 61 and extension of the horizontal piston-cylinder inclines the leg 61 relative to the body of the vehicle.

The other forward leg 60 is constructed in the same manner as leg 61 also with a horizontal piston-cylinder unit The units are operated hydraulically.

Figure 5:
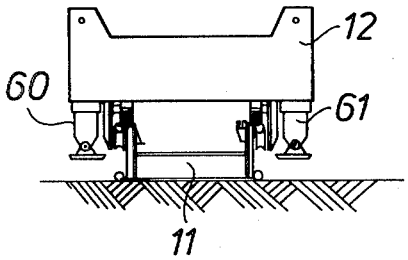
FIGS. 5 to 7 are diagrammatic views, illustrating how the apparatus can be shifted laterally.
Figure 6:
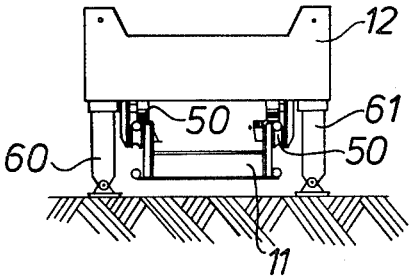
Figure 7:
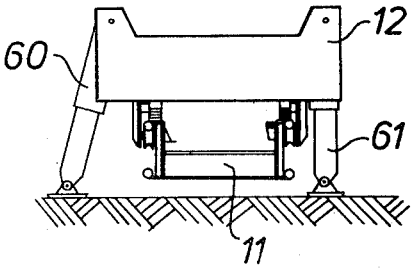

The horizontal piston-cylinder units permit sideways movement of the whole apparatus for accurate location. The operation is diagrammatically illustrated in FIGS. 5 to 7. In FIG. 5, the legs 60, 61 are shown retracted and the conveyor 11 seats on the ground with the vehicle 12 supported on the conveyor. In FIG. 6, the legs have been extended and the vehicle is shown supported on its legs 60, 61 with the conveyor held in a raised position by the captivating devices 50. The rear legs 62 would similarly be extended. In FIG. 7, one of the forward legs 60 has been inclined, so that the vehicle 12 and the part of the conveyor supported between the legs 60, 61 has been moved to one side. This permits accurate positioning of the vehicle and the conveyor for ease of clearance of debris.

The front of the conveyor is provided with a skirt 100 which has inclined ramp faces. In use, the conveyor can be rammed into debris, by movement of the conveyor with the vehicle in a raised position supported on its legs. This causes some of the debris to be picked up automatically by the conveyor. Other debris can be tipped onto the conveyor by the loading device, which is a conventional shovel-type loading device mounted on an arm 101 about a vertical pivot 102. The loading device is carried by a carriage 103 mounted for lateral movement on a lateral guide 104.

The drilling device 13 can be advanced relative to the body of the vehicle 12, so that the tool-holder 106 can be advanced forwardly of the vehicle. The device is mounted on a carriage 108 which is mounted in longitudinal guides on the vehicle. The carriage can be advanced by any desirable means, such as a chain drive or a hydraulic piston-cylinder unit.

It is envisaged that the drilling device may be used to drill holes in a wall for planting of explosive charges, the loading device being used to clear the resulting debris.

Scoop arms may be provided, if desired, on the forward part of the conveyor for scooping debris in front of the conveyor onto the conveyor.

During drilling or loading, the legs may be extended so as to stabilise the apparatus, the vehicle being at least partly supported by the legs.

In a mine, it is necessary to supply electrical and hydraulic power to the mine face, for operation of the winning machine, self-advanceable hydraulic roof supports and the face conveyor, which takes cut coal from the face. Power is supplied from one of the gates and the power equipment has to be moved as the gates are extended and the coal face retreats. The apparatus shown in FIG. 8 is power supply apparatus.

Figure 8:
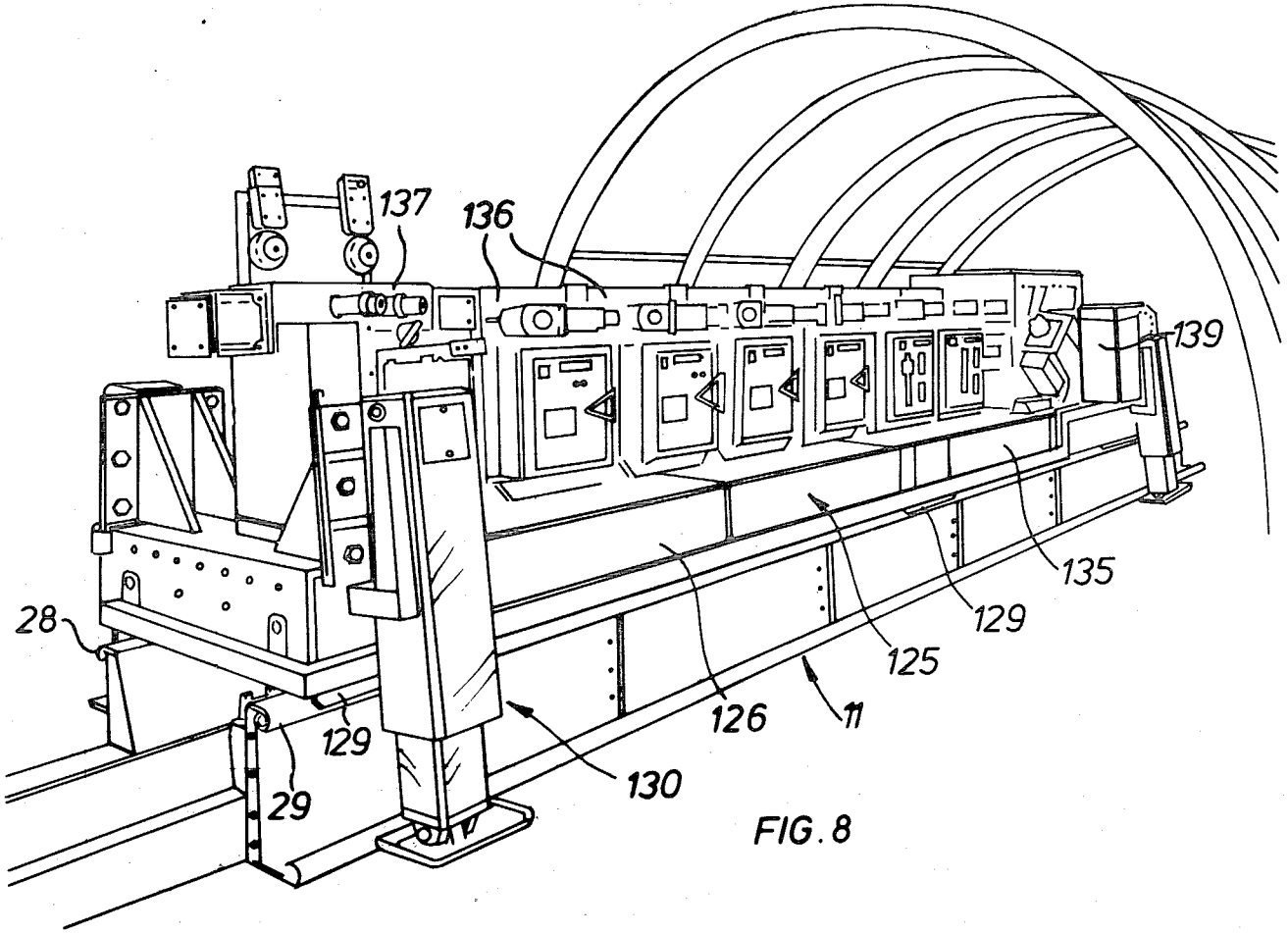
FIG. 8 is a perspective view of an alternative embodiment of the invention.

There is shown in FIG. 8 a stage loader conveyor 11, similar to that shown in FIGS. 1 or 2.

A vehicle 125 is mounted on the conveyor 11 and is provided with wheels (not shown) which engage with the rails 28, 29. The vehicle has a hollow base 126 which is provided with drive sprockets (not shown) for driving a continuous round-link chain as in the previously described embodiment. The vehicle has plates such as 129 to prevent sideways movement off the rails 28, 29.

The vehicle again mounts, at each side of the vehicle and at each end thereof, extensible legs 130. All four legs can be hydraulically extended to lift the vehicle 125 above the conveyor 11. This facilitates advancement of the conveyor relative to the vehicle by other power means, such as hydraulic rams. Advancement of the conveyor, whilst the vehicle was resting on the conveyor would be difficult, especially when heavy equipment is mounted on the vehicle.

The base 126 of the vehicle incorporates hydraulic tanks 135 and defines a platform, which supports switchgear boxes such as 136. A power pack 139 includes an electric motor hydraulic motor and pumps and is also mounted on the base, the electric motor being connected with the switchgear boxes. A communication centre 137 is also provided for communicating between positions along the coal face and the centre. The gear carried by the vehicle is conventional. The hydraulic motor serves to drive the continuous chain, to operate the extensible legs and also to provide power for the hydraulic roof supports.

The conveyor need not be a stage-loader conveyor, but may be constructed just for conveyance of the vehicle, for example, comprising a pair of parallel tracks.

At least one pair of the legs 30 may be capable of being splayed, as described with respect to FIGS. 1 to 7, for moving the conveyor and the vehicle laterally. The plates 29 may be extended downwardly, so as to bear on the conveyor as the vehicle is laterally moved.

We claim:

1. A power-supply apparatus for supplying electrical and hydraulic power to a longwall mining face installation, the apparatus comprising an advanceable track and a vehicle mounted on the track whereby the apparatus can be advanced as the mine face recedes, the vehicle having a base defining a platform, a hydraulic track incorporated in the base, power-supply means mounted on the platform, the power-supply means including electric supply means, hydraulic supply means connected with the electric supply means, and hydraulic and electric output points, drive means on the vehicle engageable with members fixed relative to the track for driving the vehicle along the track, extensible and retractable legs mounted on the base, hydraulic means connected with said hydraulic supply means and with said legs for effecting extension and retraction, and captivating means captivating the vehicle on the track, whereby upon extension of the legs the track is raised with the vehicle so that operation of said drive means causes advancement of the track relative to the vehicle.

2. A power-supply apparatus as claimed in claim 1, in which said legs include a pair of legs arranged at opposite sides of the track, means mounting said pair of legs for outward lateral movement of the legs relative to the base, further hydraulic means means for effecting said relative lateral movement and means engaging between the vehicle and the track, whereby sideways movement of both the vehicle and the track may be effected by said relative lateral movement.

3. A power-supply apparatus according to claim 1, wherein the track comprises a pair of rails and the captivating means comprises members dependent from the vehicle body and rollers rotatably mounted on the members and engaged peripherally with the underside surfaces of the rails.

4. A power supply apparatus according to claim 1 including a rack mounted on said track and defining said members fixed relative to the track, said drive means being rotatable and having positive engagement with said rack.

5. Mine excavating apparatus adapted for excavation in a mine gate and comprising and advanceable conveyor assembly including conveyor means mounted in a conveyor frame, said frame including a pair of parallel upright side walls provided at their upper edges with rails, said conveying means extending between said upright walls, an excavating vehicle mounted on the rails, the vehicle having a body, drive means on the body and engageable with members on the conveyor frame, power means for operating the drive means to drive the vehicle along the rails, extensible and retractable legs mounted on the body, hydraulic means connected with the power means for extending and retracting the legs, captivating means captivating the vehicle on the rails, whereby the vehicle and the conveyor assembly can be raised together by extension of the legs, the drive means being operable in this raised position to advance the conveyor means relative to the vehicle, said legs including a pair of legs mounted for lateral movement relative to the body, further hydraulic means connected with the power means for effecting said relative movement to steer the conveyor, the conveyor frame having a skirt at its forward end, and ramp surfaces on the skirt for directing rubble onto said conveying means as the conveyor assembly is advanced, excavating means on the body of the vehicle, and operable means on the body for working the excavating means for excavating material and depositing the material on said conveying means.

6. Mine excavating apparatus according to claim 4, wherein the captivating means comprises members dependent from the vehicle and rollers rotatably mounted on the members, the peripheral surfaces of said rollers engaging underside surfaces of said rails.

7. Mine excavating apparatus according to claim 5, wherein the excavating means comprises a hydraulically operated shovel, an arm carrying the shovel, a carriage carrying the arm, and lateral guide means on the body, the carriage being mounted on the guide means, and hydraulic means for moving the carriage along the guide means.

8. Mine excavating apparatus according to claim 5, including a rack mounted on the conveyor frame and extending parallel to the rails and defining said members on the conveyor frame, said drive means being rotatable and having positive engagement with said rack.

* * * * *